United States Patent [19]

Erickson

[11] Patent Number: 4,484,564

[45] Date of Patent: Nov. 27, 1984

[54] TAP WATER PREHEATER

[76] Inventor: Herbert V. Erickson, 1219 S. Fife, Tacoma, Wash. 98405

[21] Appl. No.: 402,605

[22] Filed: Jul. 28, 1982

[51] Int. Cl.³ ..... F24H 1/00

[52] U.S. Cl. ..... 126/365; 126/364; 122/20 B; 122/44 B; 122/235 F; 122/169; 122/DIG. 3; 165/DIG. 2; 165/DIG. 12

[58] Field of Search ..... 126/365, 364; 122/20 B, 122/44 B, 140 A, 152, 155 A, 159, 169, 235 F, DIG. 3; 165/DIG. 2, DIG. 12, 162, 161, 160, 163, 159

[56] References Cited

U.S. PATENT DOCUMENTS

| | | | |
|---|---|---|---|
| 1,893,484 | 1/1933 | Belt | 165/163 X |
| 2,108,691 | 2/1938 | Mustee | 165/163 X |
| 2,418,405 | 4/1947 | Gunter et al. | 165/163 X |
| 4,037,567 | 7/1977 | Torres | 122/20 B |

FOREIGN PATENT DOCUMENTS

| | | | |
|---|---|---|---|
| 2823977 | 12/1979 | Fed. Rep. of Germany | 165/DIG. 12 |

*Primary Examiner*—Randall L. Green

*Attorney, Agent, or Firm*—Dowrey & Cross

[57] ABSTRACT

A device for heating fluid with the exhaust gases from a furnace or stove includes a coiled fluid conduit mounted within the exhaust conduit and means such as baffles for directing the exhaust gases through and around the coiled fluid conduit. In one embodiment, the fluid in the coiled conduit is water from a cold water source which, after passing through the coil and being heated by the exhaust gases, flows to a water heating tank in a pre-heated condition.

4 Claims, 5 Drawing Figures

TAP WATER PREHEATER

BACKGROUND OF THE INVENTION

1. Field of the Invention

This invention relates to the field of energy-saving and heat-reclaiming devices.

2. Description of the Prior Art

A typical fuel-burning domestic heating system includes a furnace which burns oil, gas, coal, or the like, resulting in the production of hot exhaust gas which passes through a chimney or flue, and a water-heater tank which receives cold water and heats it for delivery to hot water taps throughout the home. Such a system has two major sources of inefficiency: the considerable loss of heat through the chimney, and the tremendous amount of energy used to heat water which, especially in cold months, is initially quite cold.

In the past, heat recovery systems involving a heat exchanger located in a flue to heat water flowing to a water heating system have been proposed, but have met with limited commercial acceptance because of the great expense of such systems compared to the small savings in energy which they produce. Some systems, like that shown in U.S. Pat. No. 4,241,588 to Murphy et al, require complicated valving and a specially adapted flue. Such systems can be costly, and cannot be economically retrofitted to existing flues and water heating systems. Other proposed systems takes up a large amount of space. Often, however, a furnace, is located in a small utility room with little or no space to spare, making such systems useless unless expensive renovation of the utility room and surrounding area is undertaken.

An inherent problem of prior art systems is the attaining of maximum efficiency for the heat exchanger. Some prior art systems involve the use of a single fluid-filled coil. In such an arrangement, exhaust gases flow through the center of the coil without transferring the maximum possible amount of heat to the coil. Thus, heat will still be exhausted out to the environment, and wasted.

SUMMARY OF THE INVENTION

The present invention is a device for heating fluid with the exhaust gases from a heat-producing apparatus, such as a furnace or stove, flowing through an exhaust conduit. The device includes a coiled fluid conduit mounted within the exhaust conduit and means such as baffles for directing the exhaust gases through and around the coiled fluid conduit, to effect the most efficient heat exchange. In one embodiment, the fluid in the coiled conduit is water from a cold water source which, after passing through the coil and being heated by the exhaust gases, flows to a water heating tank. Since the water has been pre-heated in the coil before entering the water heating tank, an appreciable amount of energy is saved.

The baffles used in the present invention ensure the flow of the hot exhaust gases through, around, and against the walls of the coil, resulting in a highly efficient heat exchange unit.

The baffles also can be adapted to serve as spacers which prevent the coil from resting against the side of the flue. Separate brackets also are provided for this purpose. In this manner, the formation of dangerous hot spots in the exhaust conduit is easily avoided without expensive, complicated, or custom-made mounting hardware. The device can be made to fit any existing flue, can be easily installed by a homeowner or other person having no special skill, and requires no extra space around a furnace.

The present invention provides a highly economical and cost effective energy-saving device for reclaiming the heat in exhaust gases passing through a flue, and pre-heating water supplied to a water heater tank.

DETAILED DESCRIPTION OF THE DRAWINGS

Figure 1:
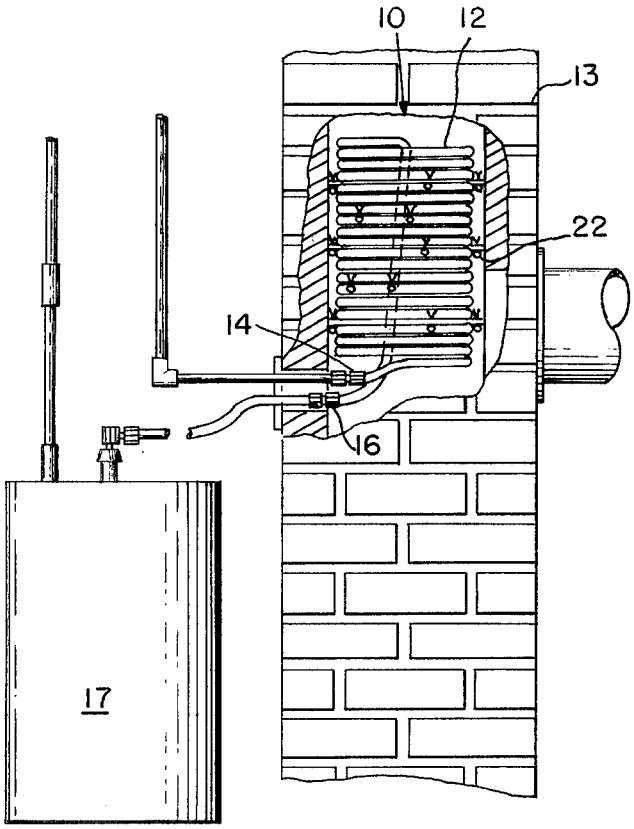
FIG. 1 is a schematic of a preferred embodiment of the invention installed in a flue.
Figure 2:
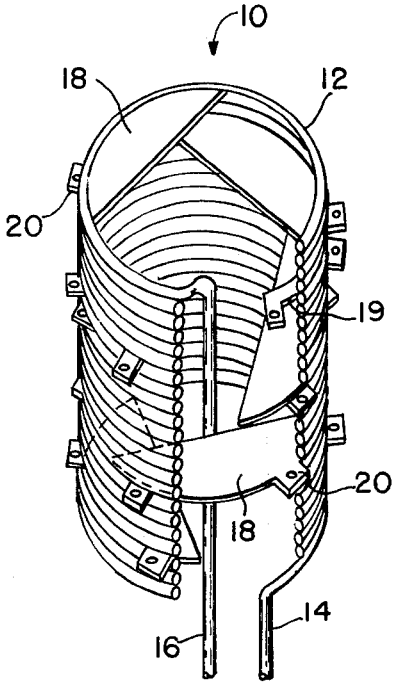
FIG. 2 is a perspective view of a preferred embodiment, partially broken away to show the positioning of baffles and brackets within the coil.

Referring to FIGS. 1 and 2, the pre-heater device 10 of the present invention includes a coil 12, preferably formed from copper tubing, positioned in a flue 13 through which hot exhaust gases produced from the burning of fuel in a conventional furnace or stove, not shown, flow. The coil 12 has an inlet 14, and approximately 20 to 25 turns, the number of turns being variable depending on the specific requirements of a particular installation. At the terminal end of the coil 12, the copper tubing passes through the interior of the coil so that the outlet 16 is in proximity to the inlet 14. This allows greater ease of installation, since the copper tubing need not pass through the flue 13 at two different locations.

The inlet 14 of the coil 12 is coupled to a source of unheated water, such as the main water line in a home. The outlet 16 of the coil 12 is coupled to a conventional domestic water heater 17. Thus, cold water flows through the inlet 14 and around the coil 12, and is heated by the gases in the flue 13. The water then flows through the outlet 16 into the water heater 17 in a pre-heated condition.

Figure 3:
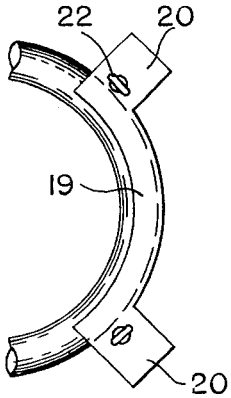
FIG. 3 is a plan view of a bracket positioned on a turn of the coil.
Figure 4:
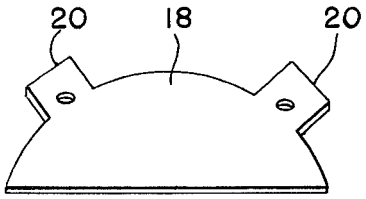
FIG. 4 is a perspective view of a baffle used in a preferred embodiment.
Figure 5:
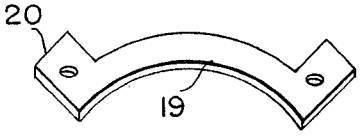
FIG. 5 is a perspective view of a bracket used in a preferred embodiment.

To ensure that the hot exhaust gases flow through and around the turns of the coil 12 to deliver heat to the coil in the most effective manner, baffles 18 such as that shown in FIG. 4 are positioned within the coil perpendicular to the length of the coil. These baffles 18 include a flat surface lying within the interior of the coil 12 and having a shape defined by the circumference of the circle formed by the turns of the coil 12 and a secant passing therethrough, and a pair of tabs 20 extending from the rounded edge of the surface. When the baffle 18 is positioned within the coil, the tabs 20 extend outwardly from the coil 12 to keep it spaced from the walls of the flue 13. The baffles 18 are spaced from each other longitudinally by about four turns of the coil, and annularly by about 70° in a direction of rotation which is identical with that of the coil when viewed on end. At a few points along the length of the coil 12, an arc-shaped bracket 19 is substituted for the above-described baffle 18. As shown in FIGS. 3 and 5, the bracket 19 does not extend into the interior of the coil 12. Like the baffle 18, the bracket 19 has a pair of tabs 20 extending outwardly therefrom. The baffles 18 maximize heat transfer to the coil 12 by shunting the flow of flue gases around and against the interior of the coil 12, while the brackets 19 eliminate the danger of blockage or obstruction of gas flow while assuring that the coil 12 will have adequate support from the tabs 20.

Referring to FIGS. 1 and 3, a retaining pin 22 passes through a hole in each tab 20 outside the coil 12 to keep the baffle 18 or bracket 19 from slipping between the turns of the coil 12. The retaining pin 22 preferably has a pair of legs which can be spread apart to prevent the pin from slipping out of the tab.

To use the device of the present invention, a coil 12 is made to the desired diameter and length for the dimensions of the flue, and the baffles 18 and brackets 19 are slipped through adjacent turns of the coil 12, and secured with retaining pins 22. The coil 12 is placed inside the flue 13, or a chimney from a stove or the like, the coupled to a water source and water heater 17. Cold water will enter the coil 12 through the inlet 14, and circulate through the coil 12. Hot exhaust gas from a furnace or stove will travel through the flue and around the coil 12, with the baffles 18 ensuring that the hot gas circulates around and against the turns of the coil 12, for the most efficient possible heat transfer. The exhaust gases heat the water which then flows through the outlet 16 into the water heater 17. Thus, heat which would normally be wasted through the flue is reclaimed, and is used to save energy in the water heating process.

The coil 12 can be installed in either a vertical or horizontal flue or chimney. Where a vertical flue has a horizontal branch, a coil can be placed in both the horizontal and vertical branches, and the outlet of one coil coupled to the inlet of the other, for the greatest heat recovery. In this case the inlet of one coil is coupled to the water source, while the outlet of the other is connected to the water heater.

Although the invention has been described with respect to a particular embodiment, it will be understood that variations are possible while remaining within the scope of the invention.

What is claimed is:

1. A device for heating a fluid with the exhaust gases from a heat producing apparatus flowing through an exhaust gas conduit comprising:

longitudinal fluid conduit means arranged in a coil and mounted within the exhaust gas conduit;

a plurality of baffles mounted to the fluid conduit means so as to form a spiral succession of baffles which will divert the exhaust gases into a spiral path along the length of the fluid conduit means in the rotational direction of the turns of the coil; and a plurality of arc-shaped brackets, each positioned between adjacent turns of the coil and each having a tab extending outwardly from the coil for spacing the coil from the wall of the exhaust gas conduit while not interfering with gas flow.

2. The device of claim 1 further comprising means for delivering the fluid to a water heater tank after the fluid is heated with the exhaust gases.

3. The device of claim 1 further comprising a retaining pin extending through each tab for retaining the brackets in a position with the tabs extending outwardly from the coil.

4. A device for heating water flowing from a cold water source to a water heating tank with exhaust gases from a heat producing device traveling through a flue comprising:

a copper tube forming a coil mounted in the flue and having a first end in fluid communication with the cold water source and a second end in fluid communication with the water heating tank;

a plurality of baffles having a shape defined by a circle and a secant passing therethrough positioned inside the coil between adjacent turns of the coil and spaced around the circumference of the coil in the direction of the turns of the coil so as to form a spiral succession of baffles which will divert exhaust gases into a spiral path along the length of the tube in the rotational direction of the coil, and having a tab extending outwardly from the coil for spacing the coil from the wall of the flue;

a plurality of arc-shaped brackets, each positioned between adjacent turns of the coil and having a tab extending outwardly from the coil for spacing the coil from the wall of the flue while not interfering with gas flow; and a retaining pin extending through each tab for retaining the baffles and brackets in a position with the tabs extending outwardly from the coil.

* * * * *